US005406255A

United States Patent [19]

Fujimoto et al.

[11] Patent Number: 5,406,255

[45] Date of Patent: Apr. 11, 1995

[54] DUPLEXED COMMUNICATION SYSTEM

[75] Inventors: Naonobu Fujimoto; Sakutaro Sato, both of Kawasaki, Japan

[73] Assignee: Fujitsu Limited, Kanagawa, Japan

[21] Appl. No.: 967,692

[22] Filed: Oct. 27, 1992

[30] Foreign Application Priority Data

Oct. 29, 1991 [JP] Japan ..... 3-282780

[51] Int. Cl.[6] ..... G08B 19/00

[52] U.S. Cl. ..... 340/522; 340/521; 340/523; 340/573; 340/526

[58] Field of Search ..... 340/522, 517, 521, 523, 340/573, 649, 650, 526

[56] References Cited

U.S. PATENT DOCUMENTS 4,660,024 4/1987 McMaster ..... 340/522
4,710,751 12/1987 Webster ..... 340/522
4,882,567 11/1989 Johnson ..... 340/522

FOREIGN PATENT DOCUMENTS 10919 1/1988 Japan .
307199 12/1990 Japan .
222525 10/1991 Japan .
259636 11/1991 Japan .
54738 2/1992 Japan .

*Primary Examiner*—Donnie L. Crosland

[57] ABSTRACT

A communication system comprising at least one working system for receiving a signal from a source, at least one protection system for receiving the signal from the source, a detection part for detecting an alarm state of the signals received via the working system and the protection system and for outputting an alarm signal if the alarm state is detected in at least one of the working system and the protection system, a switching part for selectively outputting the signal received via one of the working system and the protection system in response to a control signal which determines a connection of the switching part, and a control part for supplying the control signal to the switching part based on the alarm signals from the detection part. The control part disregards the alarm signals if the alarm signals are generated from the detection part with respect to the working system and the protection signal approximately at the same time.

12 Claims, 14 Drawing Sheets

3

DUPLEXED COMMUNICATION SYSTEM

BACKGROUND OF THE INVENTION

The present invention generally relates to communication systems, and more particularly to a duplexed communication system having a switching system which switches from a working system to a protection (or standby) system by detecting an abnormality in the systems.

In a communication system, a duplexed system configuration is employed at various parts of high-speed and low-speed parts which multiplex and demultiplex signals. If an abnormality is detected in a working system, the duplexed system is quickly switched to a protection system so as to improve the availability of the communication system. Accordingly, it is desirable in such a communication system to precisely separate the part of the working system where the abnormality was generated and to switch only the part where the abnormality occurred.

FIG. 1 shows an example of a conventional duplexed communication system. This communication system is the so-called synchronous optical network (SONET) system. In FIG. 1, transmitters are labelled "TX" receivers are labelled "RX" alarm detectors are labelled "M" switches for the lines are labelled "SW", switch controllers for the switches SW are labelled "SC" multiplexers are labelled "MUX" and demultiplexers are labelled "DMUX".

The SONET system is divided into a high-speed common part and a low-speed channel part CH, and the parts are duplexed, that is, have the redundant configuration, so as to cope with failures. The section between the transmitter TX and the receiver RX of the high-speed part are respectively referred to as a "section". The section between the multiplexer MUX and the demultiplexer DMUX is referred to as a "line". In addition, the section between the channels CH and CH of the low-speed part is referred to as a "path". The failure detection in each of these sections can be made by checking specific parity check information.

FIG.2 shows the STS-1 frame structure employed in the SONET system. One frame 100 from the STS-1 includes an overhead part 101 amounting to 9 lines×3 bytes, and a payload (information transmitting) part 102 amounting to 9 lines×87 bytes. The overhead part 101 includes a section overhead 101*a* and a line overhead 101*b*. The payload part 102 includes a path overhead 102*a*.

The section overhead 101*a* includes frame synchronizing byte information A1 and A2, and parity check byte information B1. At the part related to the section S in FIG. 1, the frame synchronization error is detected from the abnormality of the frame synchronizing byte information A1 and A2, and the bit error rate between the transmitter TX and the receiver RX is detected from the abnormality of the parity check byte information B1. The line overhead 101*b* includes parity check byte information B2. In the part related to the line L in FIG. 1, the bit error rate between the multiplexer MUX and the demultiplexer DMUX (excluding the section S) is detected from the abnormality of the parity check byte information B2. On the other hand, the path overhead 102*a* includes parity check byte information B3. In the part related to the path P in FIG. 1, the bit error rate between the channels CH and CH (including the errors caused within the line L) is detected from the abnormality of the parity check byte information B3. Hence, the parity check of the SONET system has a hierarchical structure, and the part related to the section S, for example, is not aware of the failure generated in the line L or the path P.

Returning now to the description of FIG. 1, attention is drawn to a channel CH1 on the output side, for example. Transmitters 21*a* and 21*b* respectively transmit the same transmission signal to receivers 23*a* and 23*b*. In this state, an alarm detector 24*a* outputs an alarm signal AL1 when the alarm detector 24*a* detects an alarm state of a received signal at the receiver 23*a* such as the bit error rate exceeding a predetermined value. Similarly, an alarm detector 24*b* outputs an alarm signal AL2 when the alarm detector 24*b* detects an alarm state of a received signal at the receiver 23*b*. If it is assumed for the sake of convenience that the receiver 23*a* forms the working system, a switch controller 25 receives the alarm signal AL1 from the alarm detector 24*a* but receives no alarm signal AL2 from the alarm detector 24*b*, for example. In this case, it may be judged that the failure simply exists only between the transmitter 21*a* and the receiver 23*a*, and it is possible to appropriately switch a switch 26 from a contact a to a contact b, that is, from the working system to the protection system. The switching can be made similarly if the receiver 23*b* forms the working system.

On the other hand, if a failure is generated at a demultiplexer 41*a*, for example, a switch controller 45 receives an alarm signal AL1 from an alarm detector 42*a* and receives no alarm signal AL2 from an alarm detector 42*b*. Hence, it is possible to appropriately switch a switch 46 from a contact a to a contact b, that is, from the working system to the protection system. However, it inevitably takes time for the switching operation to be completed from the time when the failure is generated, and a considerably amount of deteriorated transmission signal is transmitted as it is to the channel part during this time. As a result, the alarm signals AL1 and AL2 are generated approximately at the same time and at predetermined intervals for a plurality of times at the alarm detectors 24*a* and 24*b* of the channel part.

In such a case where the alarm signals AL1 and AL2 are generated approximately at the same time and at predetermined intervals at the alarm detectors 24*a* and 24*b*, the switch controller 25 first accepts the alarm signal AL1 from the alarm detector 24*a* of the working system and switches the switch 26 from the contact a to the contact b, and thereafter accepts the alarm signal AL2 from the alarm detector 24*b* which now forms the working system and switches the switch 26 from the contact b to the contact a.

Furthermore, if a failure is generated between a transmitter 11*a* and a receiver 13*a* of the high-speed part, for example, it is possible to appropriately switch from the working system to the protection system at a switch controller 15. But in this case, the transmission signal which is deteriorated between the transmitter 11*a* and the receiver 13*a* is distributed as it is to each of the output ports ① through ④ of the demultiplexers 41*a* and 41*b*. For this reason, the complex switching control similar to that described above was frequently carried out in the switch controller 45 on the downstream side and in the switch controllers 25 and 35 of the low-speed channel part.

Therefore, in the conventional SONET system, there was a possible problem in that the switching of the duplexed system is frequently carried out not only in the part of the system where the abnormality actually occurred but also in other parts of the system. This is a problem common to the general communication systems which carry out multiplexing and demultiplexing between high-speed and low-speed lines and switch one of N working systems to a protection system by detecting the alarm of the transmission signal at each part of the high-speed and low-speed lines, where N is an arbitrary integer. Of course, the communication system may have one protection system with respect to each working system.

In order to prevent an erroneous operation of the switch which is originally unrelated to a failure which is generated on the upstream side of the switch, various methods have been proposed.

According to a first method, a guard time is set in a switch controller. This guard time is longer than a time it takes for the part in the upstream side to start a normal operation from a time when a failure actually occurs by detecting this failure and switching the working system to the protection system. Hence, the part on the downstream side will not accept an alarm signal which is received within the set guard time, so as to prevent an erroneous switching in the downstream side part. But this first method, there was a problem in that the switching time of the downstream side part becomes considerably long.

On the other hand, a second method prevents the erroneous switching by prohibiting the switching in the downstream side part while an alarm signal is generated in the upstream side part. FIG. 3 shows an essential part of a conventional communication system which employs this third method.

In FIG. 3, a receiver 101*a* receives a signal from a working system while a receiver 101*b* receives a signal from a protection system. A switch 102 is switched in response to a control of a switch controller 103, and the signal output via the switch 102 is received by demultiplexers 105*a* and 105*b*. The switch controller 103 carries out the control based on alarm signals from the receivers 101*a* and 101*b*. A switch 106 is switched in response to a control of a switch controller 107, and the signal output via the switch 106 is received by channel parts 109*a* and 109*b*. The switch controller 107 carries out the control based on alarm signals from the demultiplexers 105*a* and 105*b*. A switch 110 is switched in response to a control of a switch controller 111. The switch controller 111 carries out the control based on alarm signals from the channel parts 109*a* and 109*b*.

In addition, the switch controller 107 prohibits the switching of the switch 106 based on the alarm signal corresponding to one of the receivers 101*a* and 101*b* selected by the switch 102. Similarly, the switch controller 111 prohibits the switching of the switch 110 based on the alarm signal corresponding to one of the demultiplexers 105*a* and 105*b* selected by the switch 106. Hence, the erroneous switching is prevented by prohibiting the switching in the downstream side part while the alarm signal is generated in the upstream side part.

However, this second method has no effect if the alarm detection time of the downstream side part is shorter than the alarm detection time of the upstream side part or, the alarm recovery time of the downstream side part is longer than the alarm recovery time of the upstream side part. Hence, it is necessary to employ the first method together with the second method. Furthermore, there is a problem in that it is essential to transmit the switching prohibiting information from one stage to another, and this second method is not suited for practical use if the plurality of stages are relatively distant from one another.

According to a third method, the erroneous switching is prevented by limiting the alarms of the downstream side part to items unrelated to the failure generated in the upstream side part. But in this case, there is a problem in that it is impossible to obtain a sufficiently high failure detection capability.

SUMMARY OF THE INVENTION

Accordingly, it is a general object of the present invention to provide a novel and useful communication system in which the problems described above are eliminated.

Another and more specific object of the present invention is to provide a communication system comprising at least one working system for receiving a signal from a source, at least one protection system for receiving the signal from the source, detection means, coupled to the working system and the protection system, for detecting an alarm state of the signals received via the working system and the protection system and for outputting an alarm signal if the alarm state is detected in at least one of the working system and the protection system, switching means, coupled to the working system and the protection system, for selectively outputting the signal received via one of the working system and the protection system in response to a control signal which determines a connection of the switching means, and control means, coupled to the detection means and the switching means, for supplying the control signal to the switching means based on the alarm signals from the detection means, where the control means disregards the alarm signals if the alarm signals are generated from the detection means with respect to the working system and the protection signal approximately at the same time. According to the communication system of the present invention, it is possible to precisely separate the part of the working system where the abnormality was generated and to switch only the part where the abnormality actually occurred.

Other objects and further features of the present invention will be apparent from the following detailed description when read in conjunction with the accompanying drawings.

DESCRIPTION OF THE PREFERRED EMBODIMENTS

First, a description will be given of the operating principle of the present invention, by referring to FIG. 4.

Figure 4:
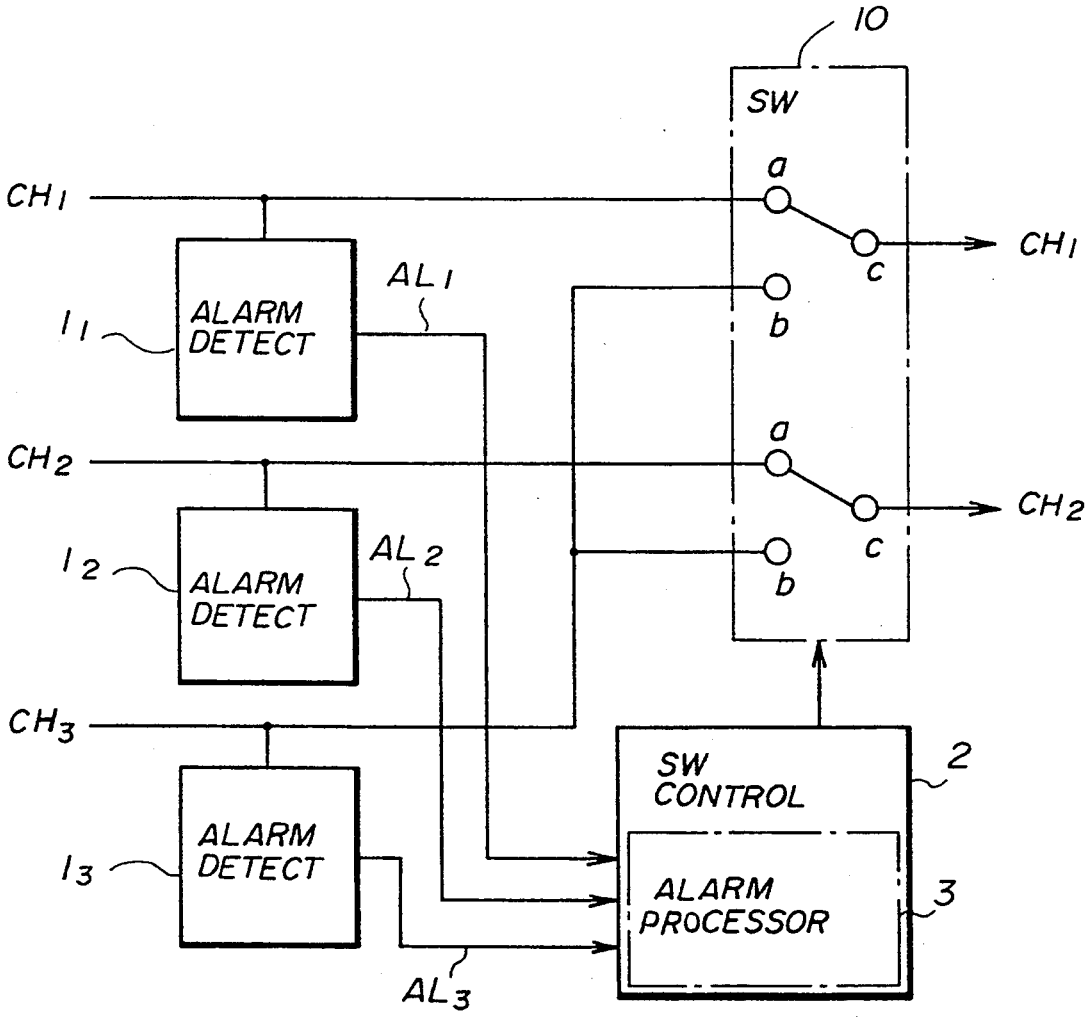
FIG. 4 is a system block diagram for explaining the operating principle of the present invention.

In FIG. 4, alarm detectors $1_1$ through $1_3$ respectively detect the alarm state of the transmission signals in a plurality of systems. A switch controller 2 controls a switch 10 based on alarm signals AL1 through AL3 from the alarm detectors $1_1$ through $1_3$. The switch controller 2 disregards the alarm signals which are generated approximately at the same time from arbitrary systems.

FIG. 4 shows a case where channels CH1 and CH2 are the channels of the working systems, and a channel CH3 is the channel of the protection system. Mutually different transmission signals are transmitted via the channels CH1 and CH2. The channel CH3 is normally connected to the channel CH1 or CH2 at the transmitting side (not shown), and thus, the transmission signal transmitted via the channel CH3 is identical to that transmitted via the channel CH1 or CH2.

Each alarm detector $1_i$ detects the alarm state of the transmission signal which is transmitted via each channel , such as the synchronization error, deterioration of the bit error rate, the line disconnection and the like, where i=1, 2 and 3 for the case shown in FIG. 4. If the alarm detector 1 detects the alarm state, the alarm detector $1_i$ outputs an alarm signal AL1. The switch controller 2 controls the switch 10 based on the alarm signals AL1 through AL3, but disregards the alarm signals which are generated approximately at the same time in two or more systems.

The present state, that is, the working system which is presently being used, is maintained if none of the alarm signals AL1 through AL3 are generated. If only the alarm signals AL1 or AL2 is generated, it may be regarded that the failure is generated only in the channel CH1 or CH2, and thus, the contact of the switch 10 for the channel CH1 or CH2 is switched to the contact b. On the other hand, if only the alarm signal AL3 is generated when the channel CH3 is being used as the working system in place of the channel CH1 or CH2, the contact of the switch 10 for the channel CH1 or CH2 is switched to the contact a. Hence, the switching of the switch 10 in these cases is basically the same as in the conventional communication system described above.

If the alarm signals AL1 and AL3 are generated approximately at the same time, it may be regarded that the failure is generated in the system of the channel CH1 prior to the multiplexing at the preceding stage or the common output port of the demultiplexer, and thus, the alarm signals AL1 and AL3 are disregarded. Similarly, the alarm signals AL2 and AL3 are disregarded if these alarm signals AL2 and AL3 are generated approximately at the same time. If the alarm signals AL1, AL2 and AL3 are generated approximately at the same time, it may be regarded that the failure is generated in the high-speed part of the preceding stage or the demultiplexer, and thus, the alarm signals AL1, AL2 and AL3 are disregarded.

The duplexed ratio of the number of protection systems to the number of working systems may be 1:N, and N=2 in the above described case. However, this duplexed ratio may be 1:1 if the system of the channel CH2 is omitted in FIG. 4. Further, one protection system may be provided with respect to each working system. By providing the switch controller 2 at each part of the communication having the above duplexed ratio 1:N, it becomes possible to precisely separate the part of the working system where the abnormality was generated and to switch only the part where the abnormality actually occurred.

The switch controller 2 may be provided with an alarm signal processor 3 for mutually cancelling the alarm signals which are generated approximately at the same time for arbitrary systems and for otherwise passing the alarm signal. In this case, there is no need to modify the switching algorithm of the existing switch controller.

Therefore, the switching time becomes slightly longer in the present invention, but the increase in the switching time only corresponds to the time required to absorb the time difference which is generated when the same signal is applied to the alarm detectors having the same construction. In other words, the increase in the switching time is extremely small compared to the guard time which is used in the first conventional method described above. In addition, unlike the second conventional method, the present invention does not require the transmission of the switching prohibiting information between the switch controllers. Furthermore, the present invention does not restrict the selection of the items of the alarm as in the case of the third conventional method, thereby enabling a sufficiently high failure detection capability and a highly reliable communication.

Figure 1:
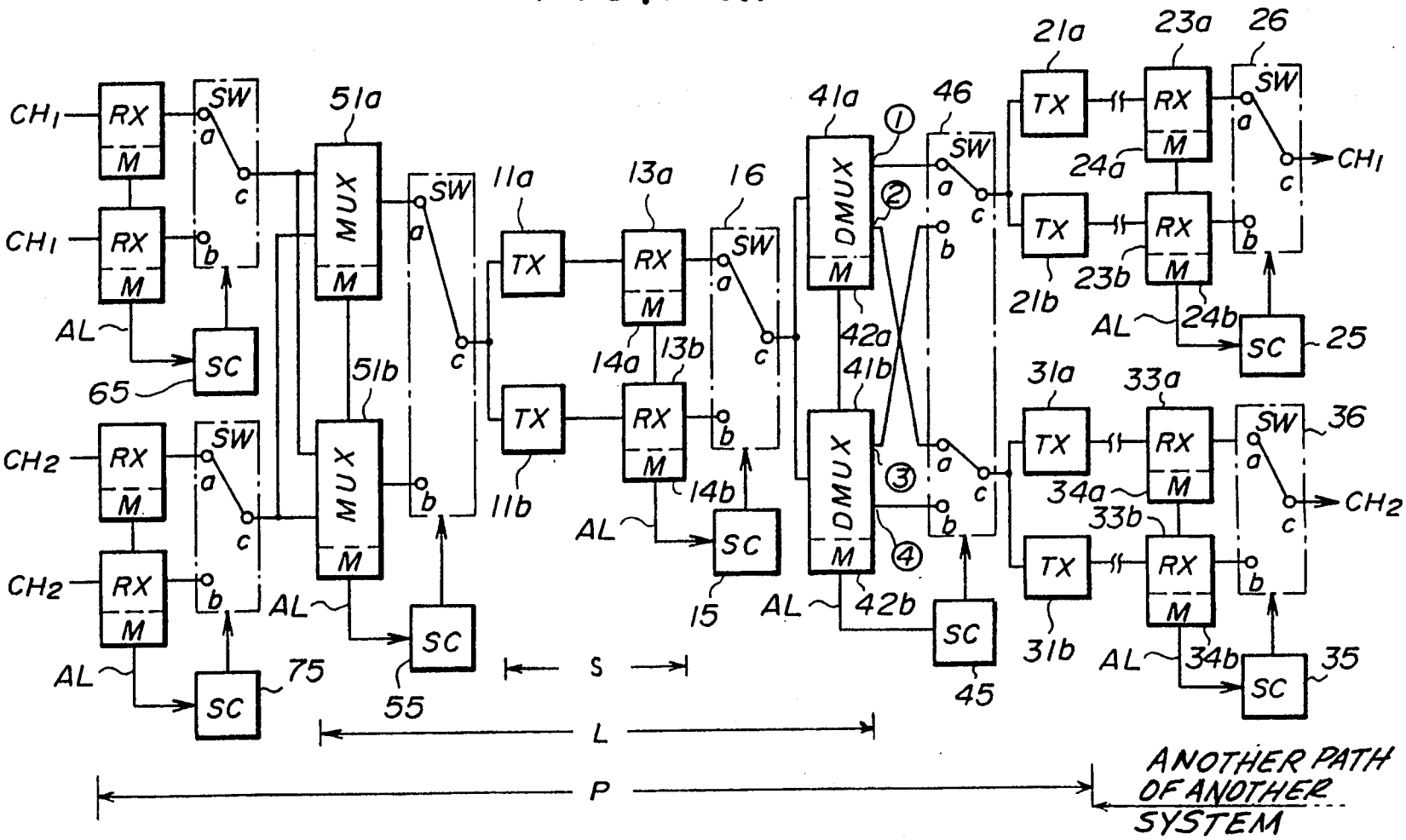
FIG. 1 PRIOR ART
FIG. 1 is a system block diagram showing an example of a conventional communication system.
Figure 2:
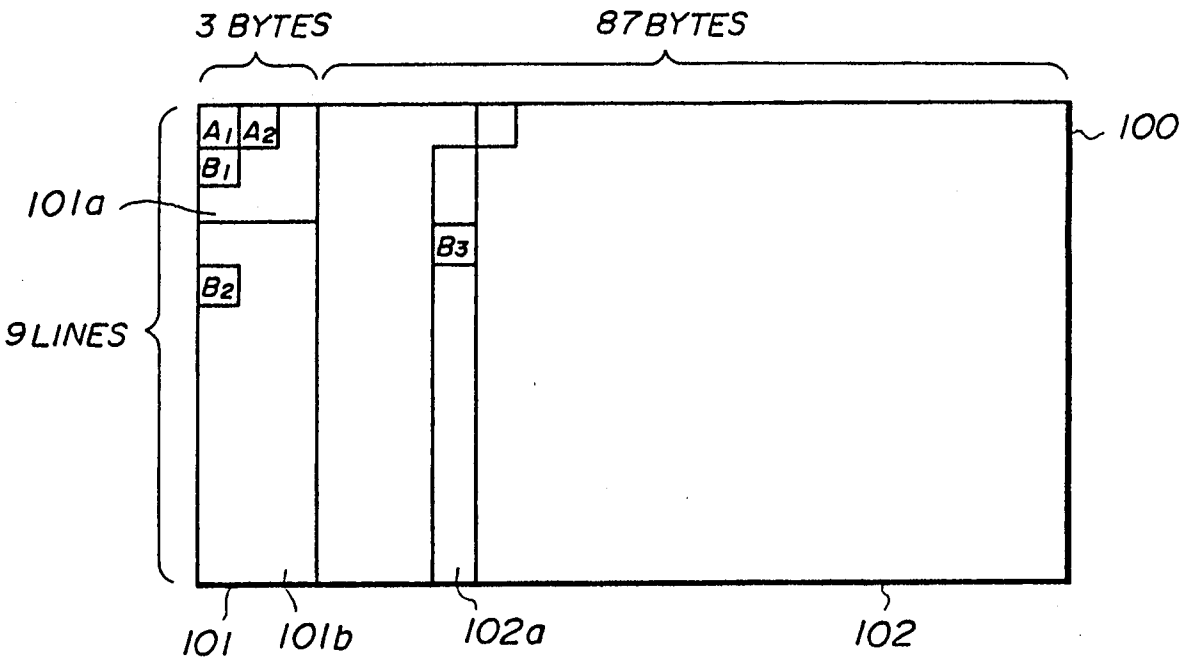
FIG. 2 PRIOR ART
FIG. 2 shows the structure of a STS-1 frame of the SONET system.
Figure 3:
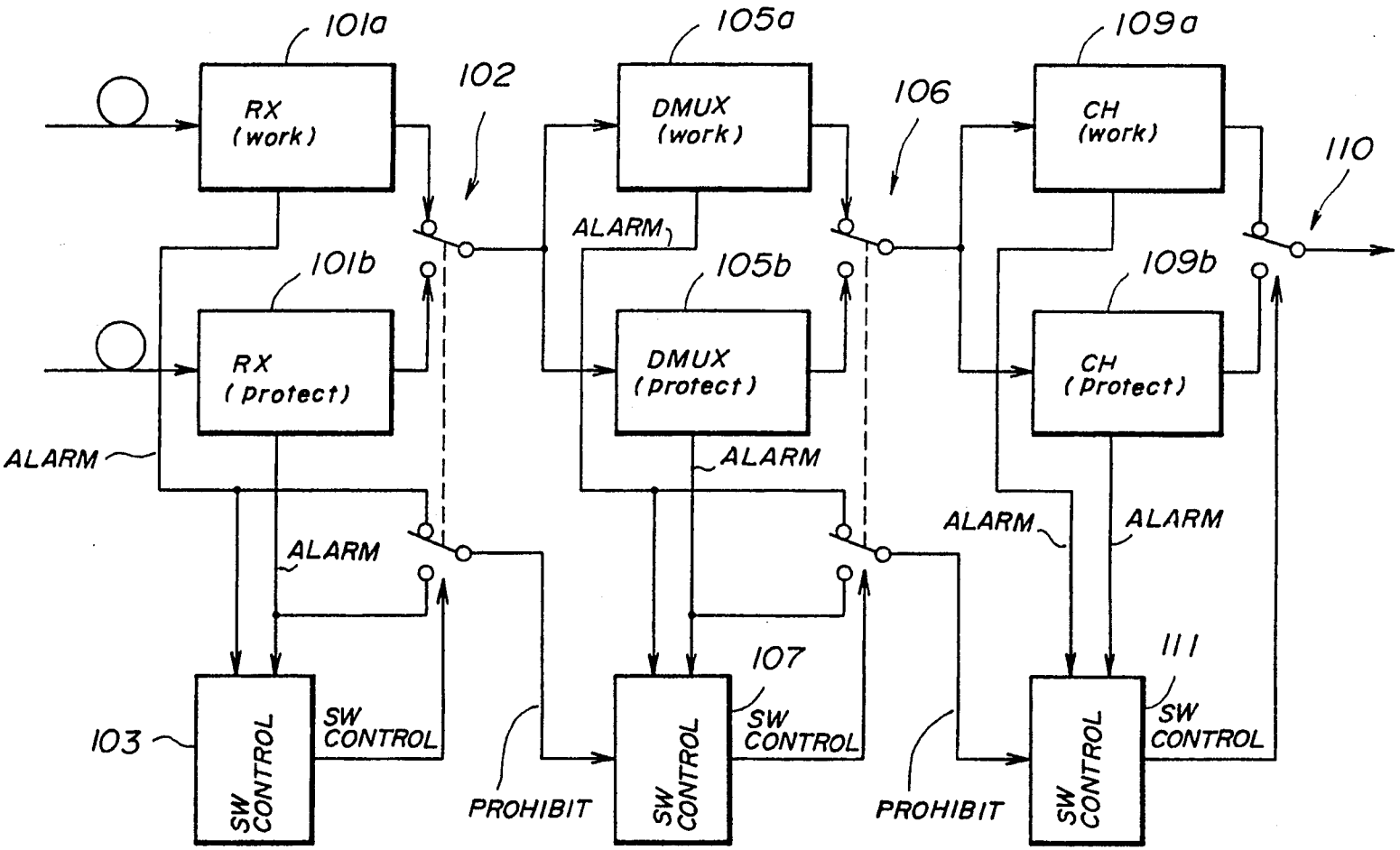
FIG. 3 PRIOR ART
FIG. 3 is a system block diagram for explaining the problems of a second conventional method.
Figure 5:
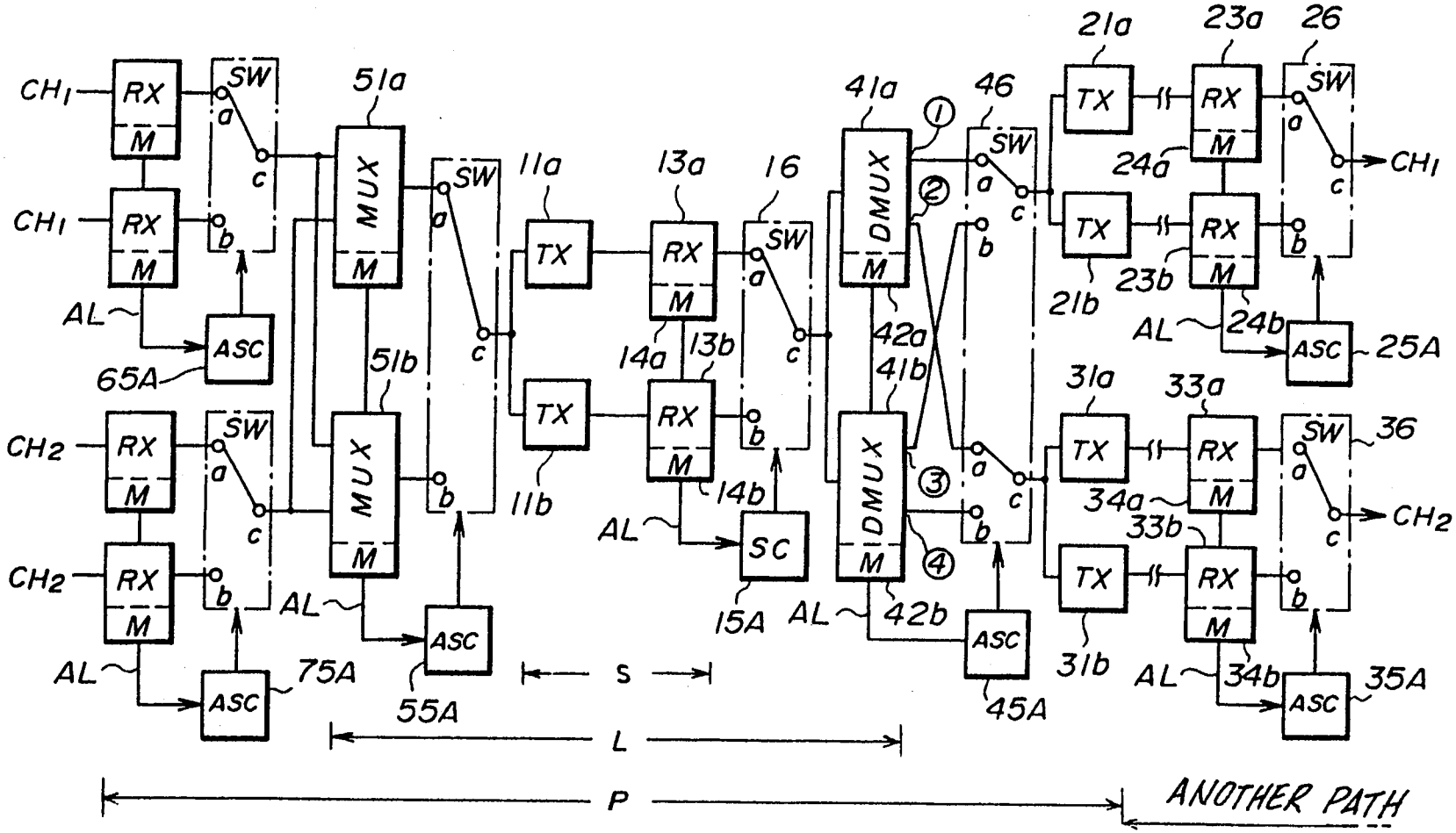
FIG. 5 is a system block diagram showing a first embodiment of a communication system according to the present invention.

Next, a description will be given of a first embodiment of a communication system according to the present invention, by referring to FIG. 5. In FIG. 5, those parts which are the same as those corresponding parts in FIG. 1 are designated by the same reference numerals, and a description thereof will be omitted. In this embodiment, the present invention is applied to the SONET system.

In FIG. 5, switch controllers which form an essential part of the present invention are labelled "ASC". In this particular embodiment, the alarm signals AL1 and AL2 are disregarded if the alarm signals AL1 and AL2 are generated approximately at the same time for the two systems, and the duplexed system is otherwise switched based on the alarm signal AL1 or AL2. A description will hereinafter be given of the switch control operation of each of the switch controllers 65A, 75A, 55A, 15A, 45A, 25A and 35A of the communication system.

The switch controller 25A maintains the present state if neither the alarm signal AL1 nor AL2 is generated. In addition, if only the alarm signal AL1 or AL2 is generated, it may be regarded that the failure is generated between the transmitter 21*a* and the receiver 23*a* or generated only between the transmitter 21*b* and the receiver 23*b*, and thus, the switch controller 25A switches the switch 26 to the contact b or a. Next, if the alarm signals AL1 and A12 are generated approximately at the same time, it may be regarded that the failure is generated in the system of the channel CH1 on the upstream side prior to the demultiplexing, between the transmitter 11*a* and the receiver 13*a* of the high-speed part or, in the demultiplexer 41*a*, and thus, the alarm signals AL1 and AL2 are disregarded. The switch control operations of the other switch controllers 35A and 45A are similar to that of the switch controller 25A. It is possible to enable checking of the parity error. Accordingly, the switch control operation described above is similarly applicable to the switch controllers 15A, 55A, 65A and 75A shown in FIG. 5. Therefore, this embodiment can precisely separate the part of the SONET system where the abnormality was generated and to switch only the part where the abnormality actually occurred.

Preferably, the switch controller is provided with the alarm signal processor 3 shown in FIG. 4 for mutually cancelling the alarm signals which are generated approximately at the same time for arbitrary systems and for otherwise passing the alarm signal.

Figure 6:
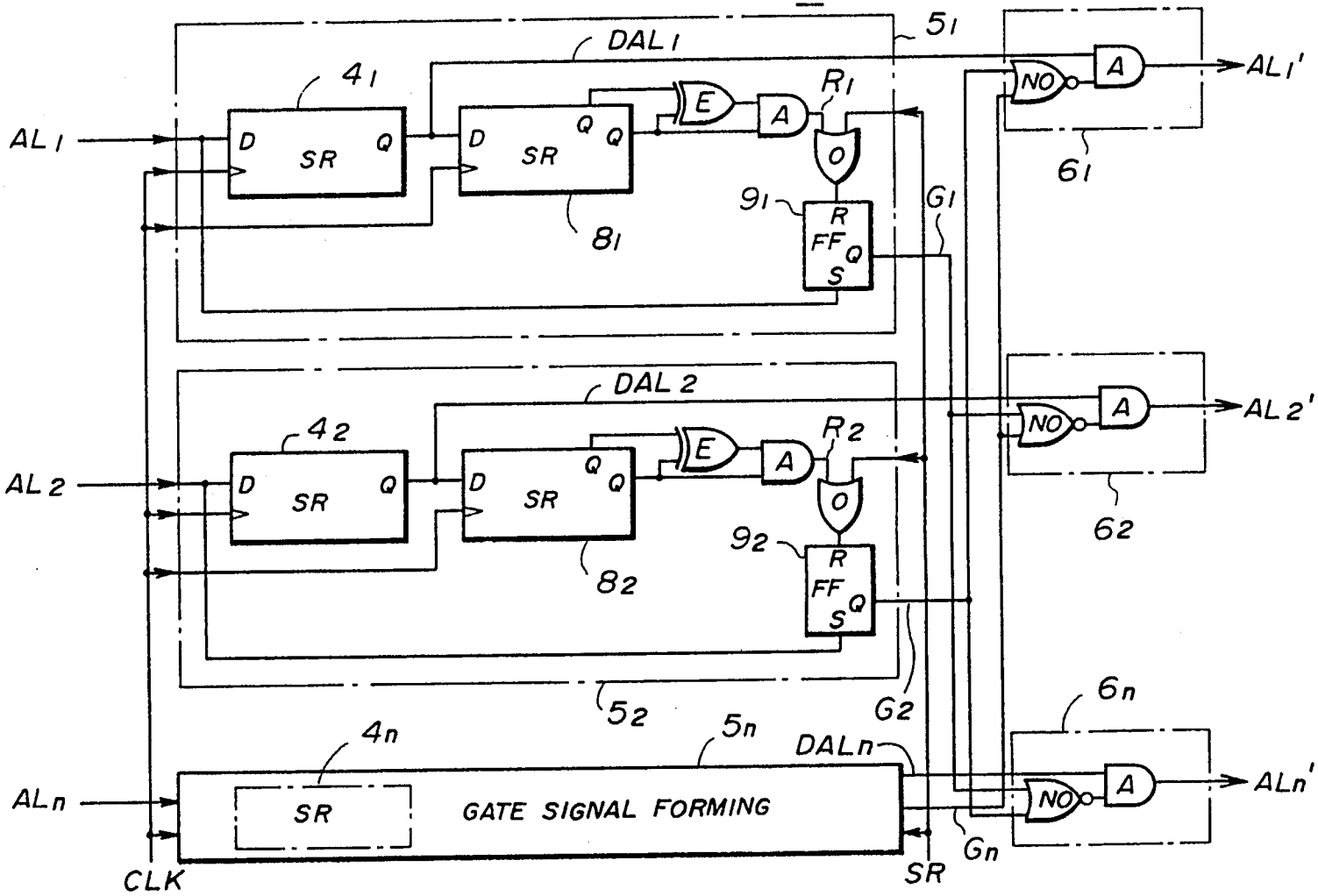
FIG. 6 is a system block diagram showing a first embodiment of an alarm signal processor.
Figure 7A:
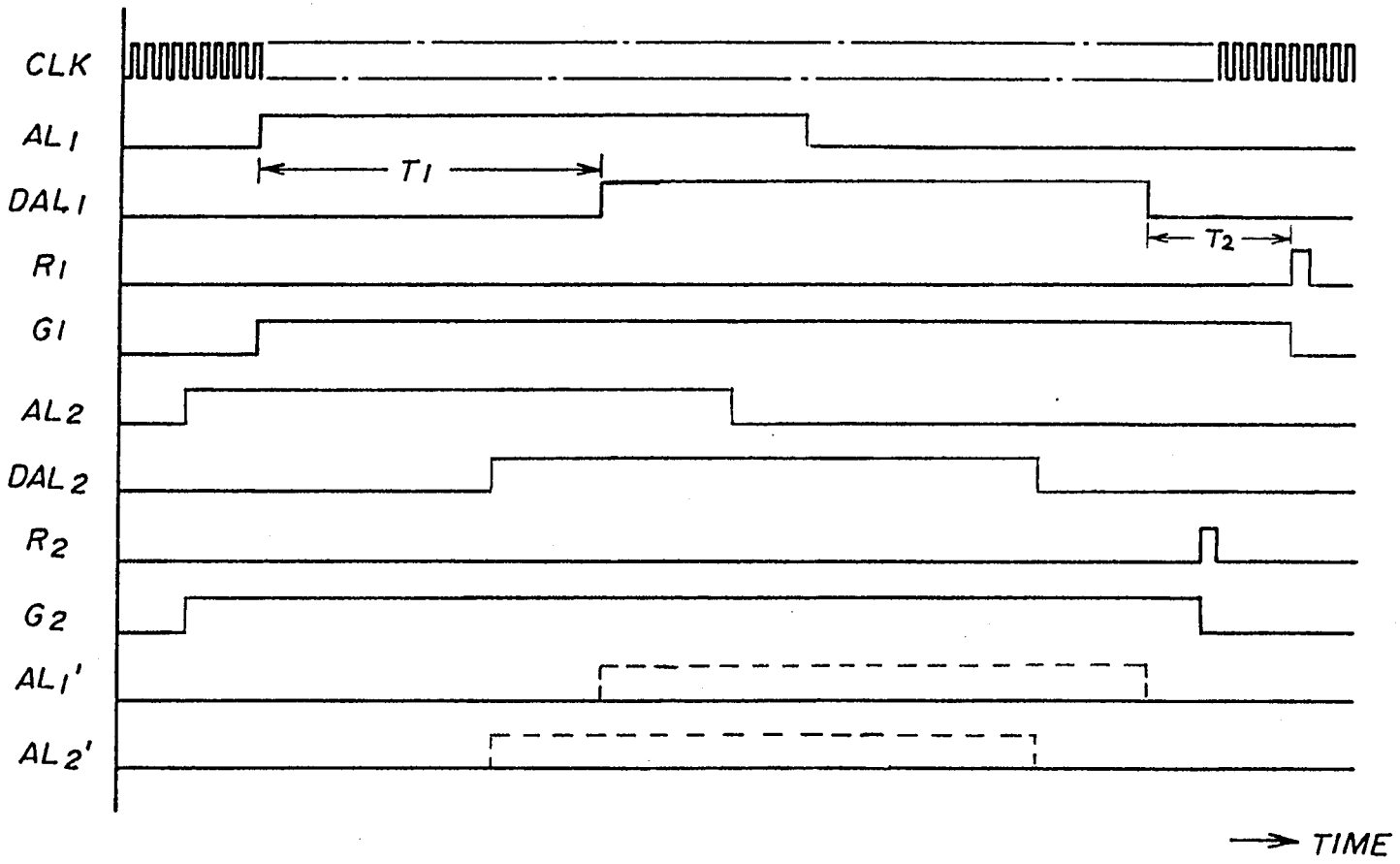
FIGS. 7A and 7B are timing charts for explaining the operation of the alarm signal processor shown in FIG. 6.
Figure 7B:
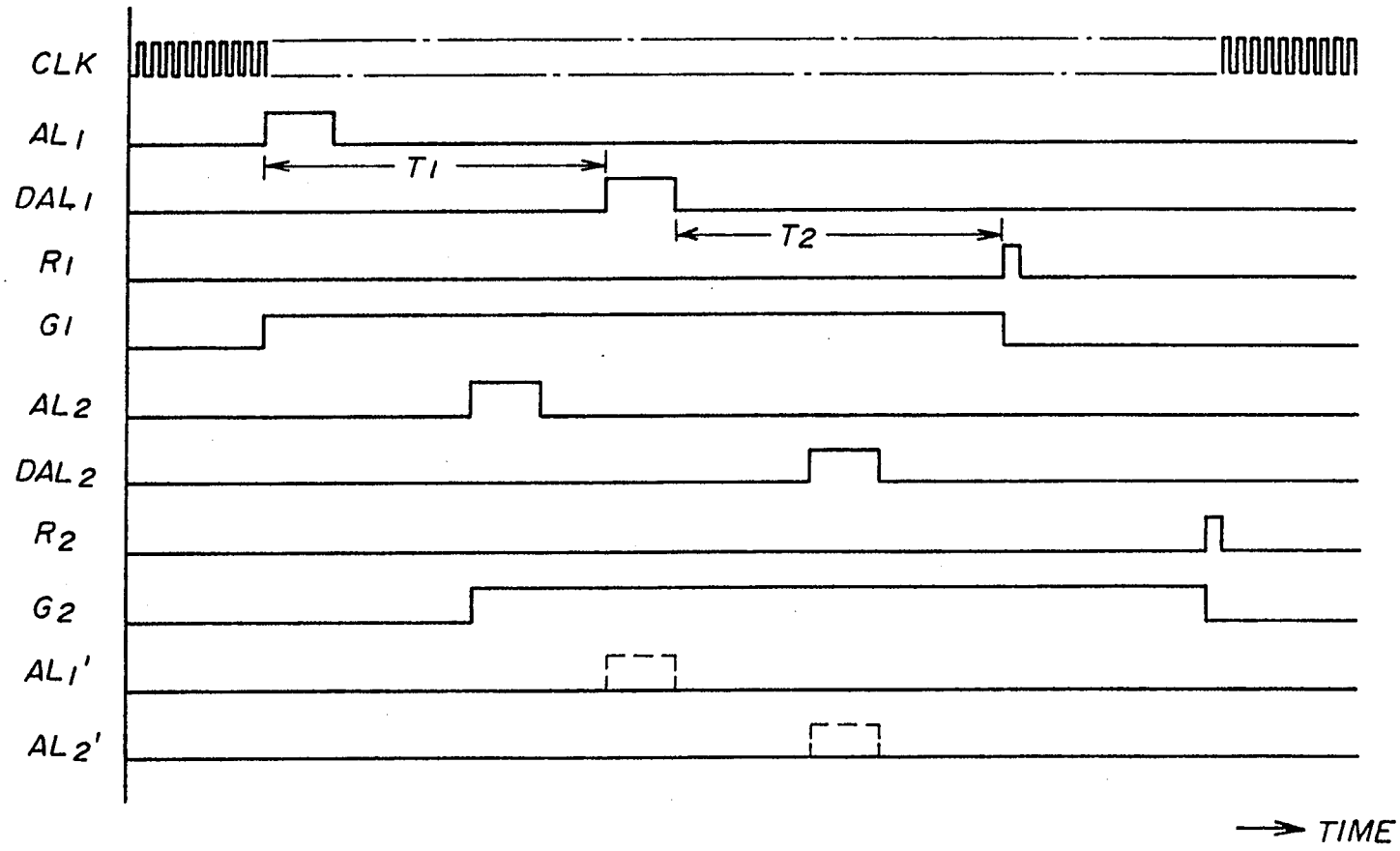

FIG. 6 shows a first embodiment of the alarm signal processor 3. The alarm signal processor 3 shown in FIG. 6 includes gate signal forming circuits $5_l$ through $5_n$, and gate circuits $6_l$ through $6_n$. Each gate signal forming circuit $5_j$ includes a delay circuit $4_j$, a shift register $8_j$, a flip-flop $9_j$, an exclusive-OR circuit E, an AND circuit A, and an OR circuit 0 which are connected as shown, where j=1, . . . , n. Each gate circuit 6*j* includes a NOR circuit NO and an AND circuit A. FIGS. 7A and 7B are timing charts for explaining the operation of the alarm signal processor 3 shown in FIG. 6. FIG. 7A shows the case where the duration of the alarm signal is longer than the first time (leading guard time) T1, while FIG. 7B shows the case where the duration of the alarm signal is shorter than the first time (leading guard time) T1.

For example, the delay circuit 41 is made up of a shift register SR having 10 stages. This shift register SR successively shifts the alarm signal AL1 in response to a clock signal CLK having a frequency of 1 kHz, so that a delayed alarm signal DAL1 which is delayed by a first time T1 (=10 ms) is obtained from an output terminal Q thereof. The shift register $8_l$ which is connected in series to the delay circuit $4_l$ also has 10 stages. Hence, the gate signal forming circuit $5_l$ forms a gate signal (inhibit signal) G1 having the first time (leading guard time) T1, the trailing guard time T2 and the duration of the alarm signal itself (delayed by T1). Thus, it is possible to cancel other channel alarms which do not occur precisely at the same time but within the guard times T1 and T2. In other words, the flip-flop $9_l$ is forcibly set by the rising edge of the alarm signal AL1, and is next forcibly reset by a signal R1 which is obtained by differentiating the trailing part of the output signal of the shift register $8_1$. The gate signal G1 is obtained from an output terminal Q of the flip-flop $9_l$. The operations of the other delay circuits $4_2$ through $4_n$ and the gate signal forming circuits $5_2$ through $5_n$ are the same as those of the delay circuit $4_l$ and the gate signal forming circuit $5_1$. The gate circuit $6_l$ blocks the delayed alarm signal DAL1 output from the delay circuit $4_l$ by a logical sum signal of the other gate signals $G_2$ through $G_n$. The operations of the other gate circuits $6_2$ through $6_n$ are the same as that of the gate circuit $6_l$.

Accordingly, if only the alarm signal AL1 is input to the alarm signal processor 3, the gate signals G2 through Gn are not formed, and an alarm signal AL1' (=DAL1) is obtained at the output of the gate circuit $6_l$. However, if one or more alarm signals out of the alarm signals AL2 through ALn are input to the alarm signal processor 3 approximately at the same time as the input of the alarm signal AL1, that is, input within the first time T1, the output of the alarm signal AL1' is blocked by the corresponding one or ones of the gate signals G2 through Gn. At the same time, the output of the corresponding one or ones of the delayed alarm signals AL2' through ALn' is also blocked by the gate signal G1.

The first time (leading gurad time) T1 determines the time range of the arrival times of the alarm signals which may be considered as being received approximately at the same time. Hence, this first time T1 should be determined by taking into consideration the timing tolerance of the alarm state detection timings of each of the alarm detectors M. The first embodiment of the alarm signal processor 3 shown in FIG. 6 is effective even when the pulse width of the alarm signal is narrower than the time width (first time, or leading guard time) which may be considered as being approximately the same time. The trailing guard time T2 determines the time range of the release times of the alarm signals which may be considered as being released approximately at the same time. Normally T1=T2.

On the other hand, because the time widths of the gate signals G1 through Gn at the gate signal forming circuits $5_l$ through $5_n$ are respectively selected to twice the first time T1, this means that the alarm signals AL1 through ALn which are generated approximately at the same time are mutually cancelled under the same condition.

Of course, it is possible to select the time width (second time) of only the gate signal G1, for example, to a value larger than twice the first time T1. In this case, if the alarm signal AL1 is first generated, the other alarm signals AL2 through ALn which are generated slightly after the first time T1 can also be masked forcibly. In general, by making the time T1 or T2 with respect to a certain system different from that with respect to another system, it is possible to realize various weighted switch control operations with respect to the certain system.

Figure 8:
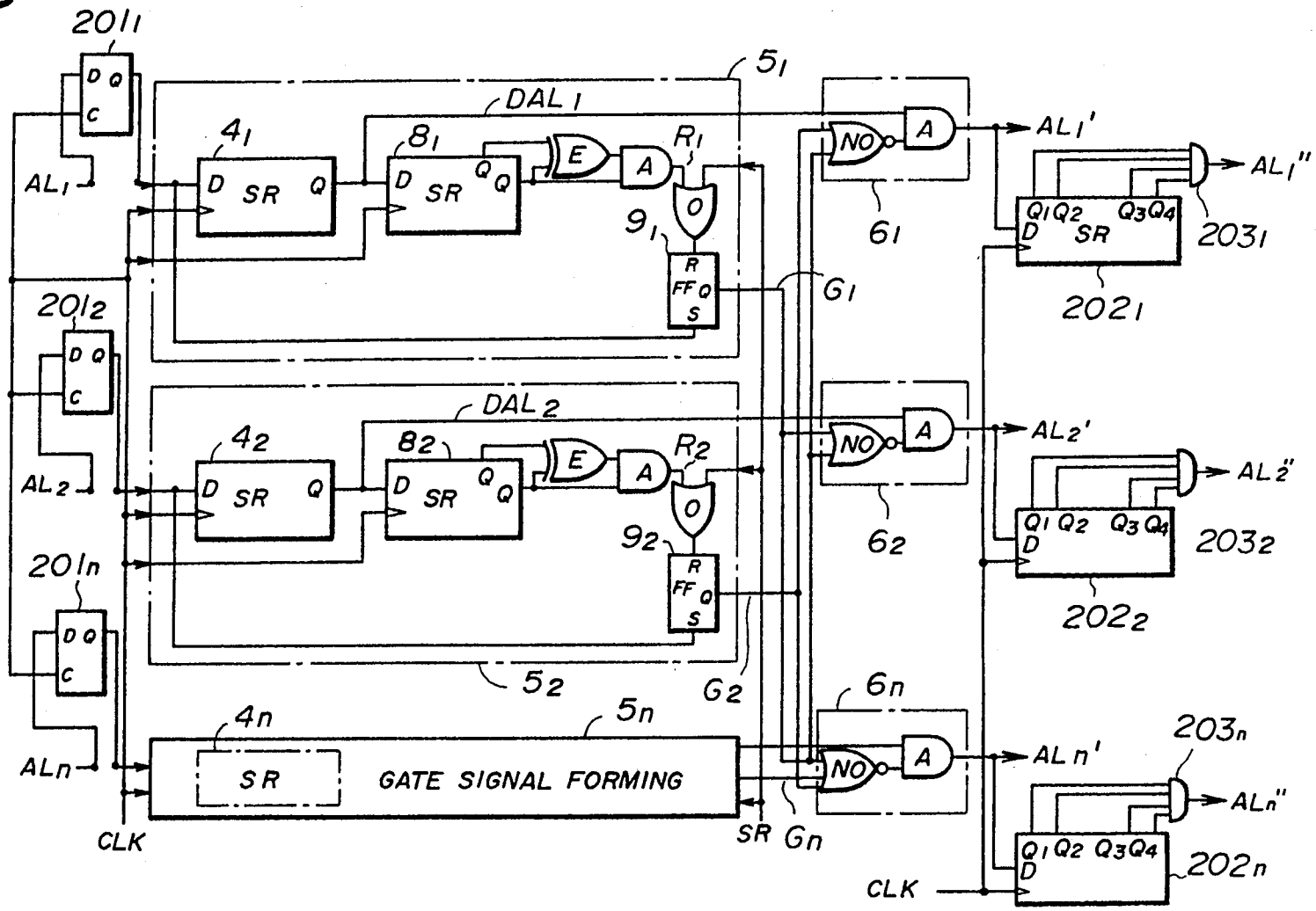
FIG. 8 is a system block diagram showing a modification of the alarm signal processor shown in FIG. 6.

FIG. 8 shows a modification of the first embodiment of the alarm signal processor 3 shown in FIG. 6. In FIG. 8, those parts which are the same as those corresponding parts in FIG. 6 are designated by the same reference numerals, and a description thereof will be omitted.

In the alarm signal processor 3 shown in FIG. 6, the flip-flop 9*j* may remain set and the alarm signal may remain blocked if the alarm signal exists for only an extremely short time which is shorter than the period of the clock signal CLK applied to the shift registers 4*j* and 8*j*. In order to overcome this problem, it is possible to increase the frequency of the clock signal CLK. However, such an increase of the clock signal frequency is undesirable in that the circuit scale will increase due to the increase in the number of stages of each shift register and the power consumption will increase due to the high-speed operation. This modification of the alarm signal processor 3 shown in FIG. 8 eliminates this problem.

In FIG. 8, a flip-flop 201*j* is provided on the input side of the gate signal forming circuit $5_i$, so as to prevent an erroneous operation even if the alarm signal only exists for an extremely short time which is shorter than the period of the clock signal CLK. The flip-flops $201_l$ through $201_n$ form an erroneous operation preventing circuit. According to this modification, a case may occur where the switching will not be carried out even though one of the alarm signals is detected if the time width of the alarm signal is shorter than the period of the clock signal CLK. But the switch controller ASC is normally designed not to operate unless the alarm signal exists for over a predetermined time, and no problem will be caused thereby.

On the other hand, it is also possible to provide a protection circuit on the output side of the gate circuit $6_j$ as shown in FIG. 8. A shift register $202j$ of the protection circuit receives the alarm signal ALj' output from the gate circuit $6_j$. An AND circuit $203_j$ of the protection circuit receives signals output from output terminals Q1 through Q4 of the shift register $202j$, and outputs an alarm signal ALj''. In this case, the switching will not be carried out unless the time width of the alarm signal is greater than or equal to a predetermined time.

Of course, it is possible to provide only one of the erroneous operation preventing circuit and the protection circuit.

Figure 9:
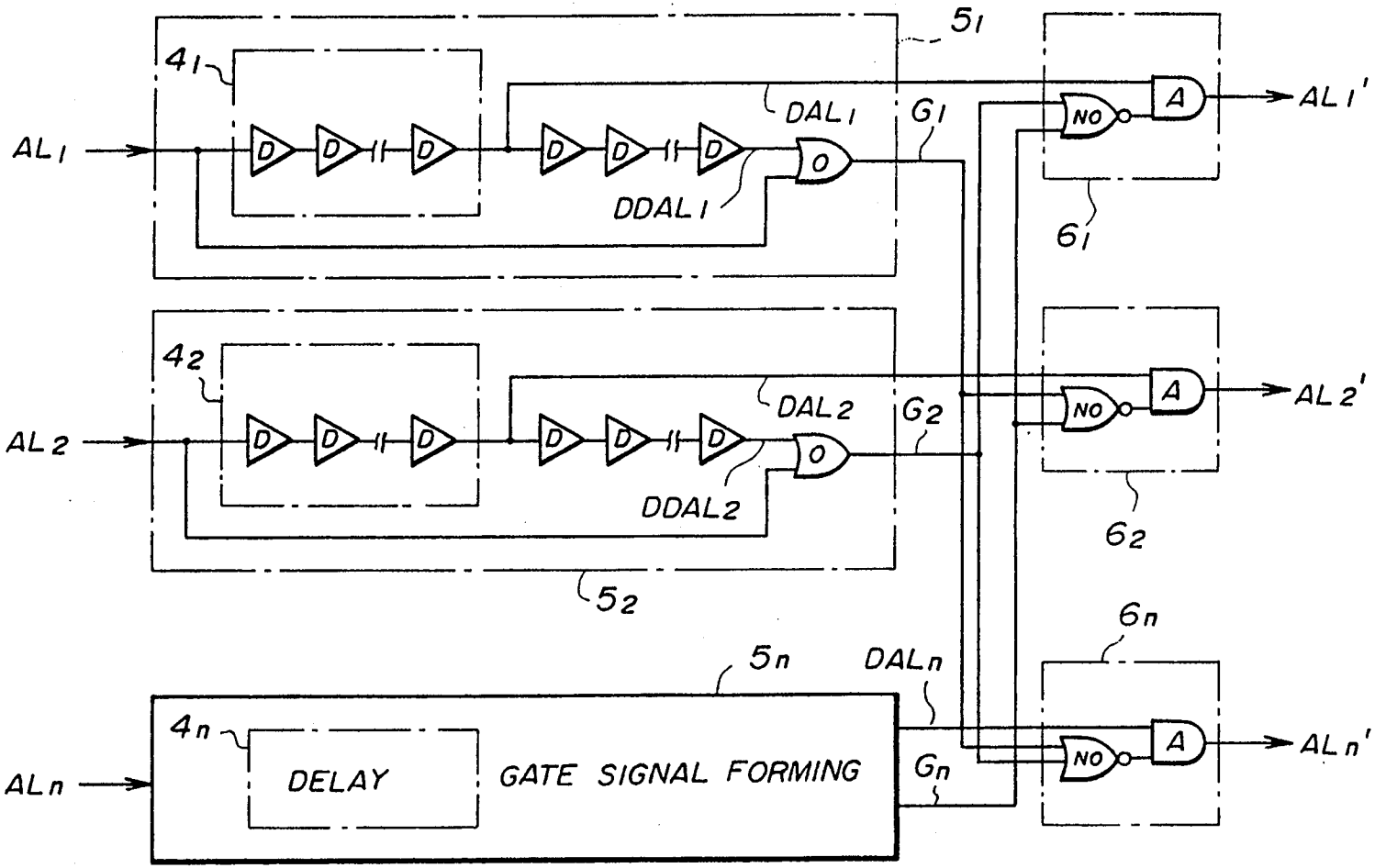
FIG. 9 is a system block diagram showing a second embodiment of an alarm signal processor.
Figure 10:
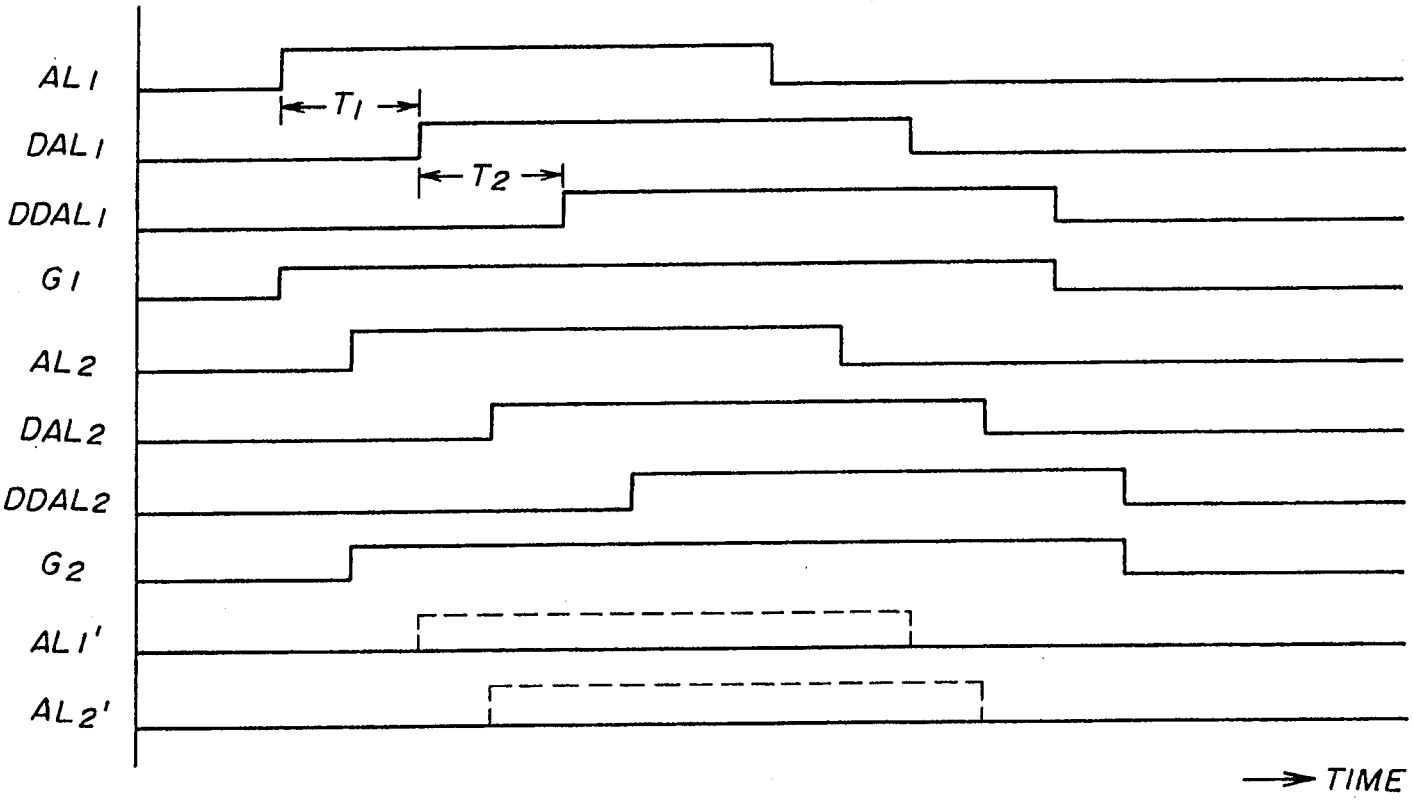
FIG. 10 is a timing chart for explaining the operation of the alarm signal processor shown in FIG. 9.

Next, a description will be given of a second embodiment of the alarm signal processor 3. FIG. 9 shows the second embodiment of the alarm signal processor 3. In FIG. 9, those parts which are the same as those corresponding parts in FIG. 6 are designated by the same reference numerals, and a description thereof will be omitted. Further, FIG. 10 is a timing chart for explaining the operation of the alarm signal processor 3 shown in FIG. 9.

In FIG. 9, each delay element D within the gate signal forming circuits $5_l$ through $5_n$ has a delay time $\Delta t$ of 100 $\mu$s, for example. The delay elements D which are connected in series form a delay buffer circuit.

For example, the delay circuit $4_l$ is made up of the delay elements D which are connected in series in 5 stages. Hence, the input alarm signal AL1 is successively delayed by the delay elements D, and the delayed alarm signal DAL1 which is delayed by the first time T1 (=500 $\mu$s) is obtained from the delay element D which is provided at the output (last) stage of the delay circuit $4_l$. A delay buffer circuit which is connected to the output of the delay circuit $4_1$ is made up of the delay elements D which are connected in series in 5 stages. Accordingly, the gate signal forming circuit $5_l$ in response to the alarm signal AL1 forms the gate signal G1 having a pulse width which is obtained by adding the signal width of the alarm signal AL1 and a time width (second time) T1=T2 (=1000 $\mu$s). The other delay circuits $4_2$ through $4_n$ and the gate signal forming circuits $5_2$ through $5_n$ operate similarly to the delay circuit $4_l$ and the gate signal forming circuit $5_n$. The gate circuit $6_1$ blocks the other gate circuits $6_2$ through $6_n$ operate similarly output of the delayed alarm signal DAL1 by the logical sum signal of the other gate signals G2 through Gn. The to the gate circuit $6_2$ through $6_n$ operate similarly to the gate circuit $6_1$.

Accordingly, if only the alarm signal AL1 is input to the alarm signal processor 3 shown in FIG. 9, the gate signals G2 through Gn are not formed, and the alarm signal AL1' (=DAL1) is obtained at the output of the gate circuit $6_1$. However, if one or more alarm signals out of the alarm signals AL2 through ALn are input to the alarm signal processor 3 approximately at the same time as the input of the alarm signal AL1, that is, input within the first time T1, the output of the alarm signal AL1' is blocked by the corresponding one or ones of the gate signals G2 through Gn. At the same time, the output of the corresponding one or ones of the delayed alarm signals AL2' through ALn' is also blocked by the gate signal G1.

Therefore, the second embodiment of the alarm signal processor 3 has an advantage in that the circuit construction becomes simple if the pulse width of the alarm signal is greater than the time width (first time, or leading guard time) which may be considered as being approximately the same time.

Figure 11:
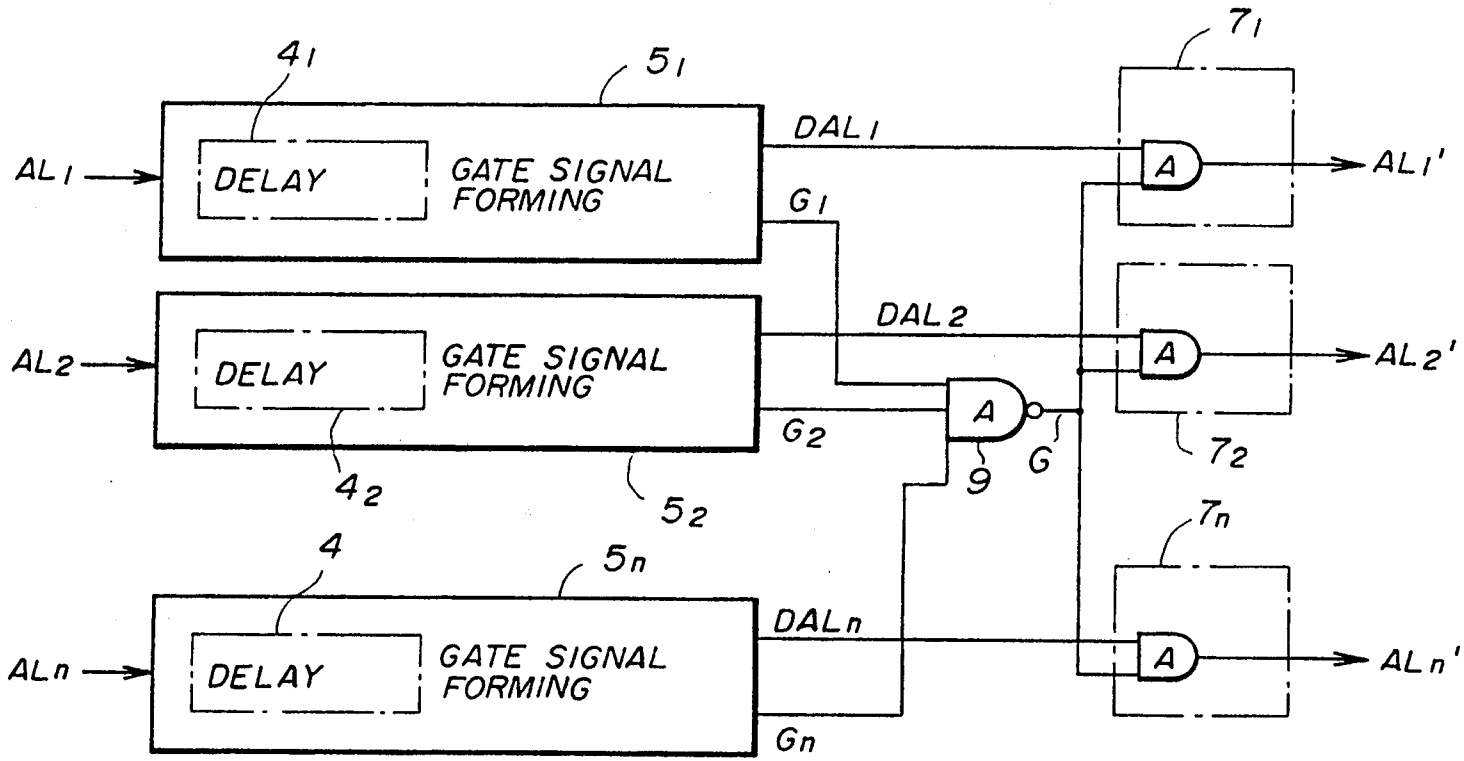
FIG. 11 is a system block diagram showing a third embodiment of an alarm signal processor.
Figure 12:
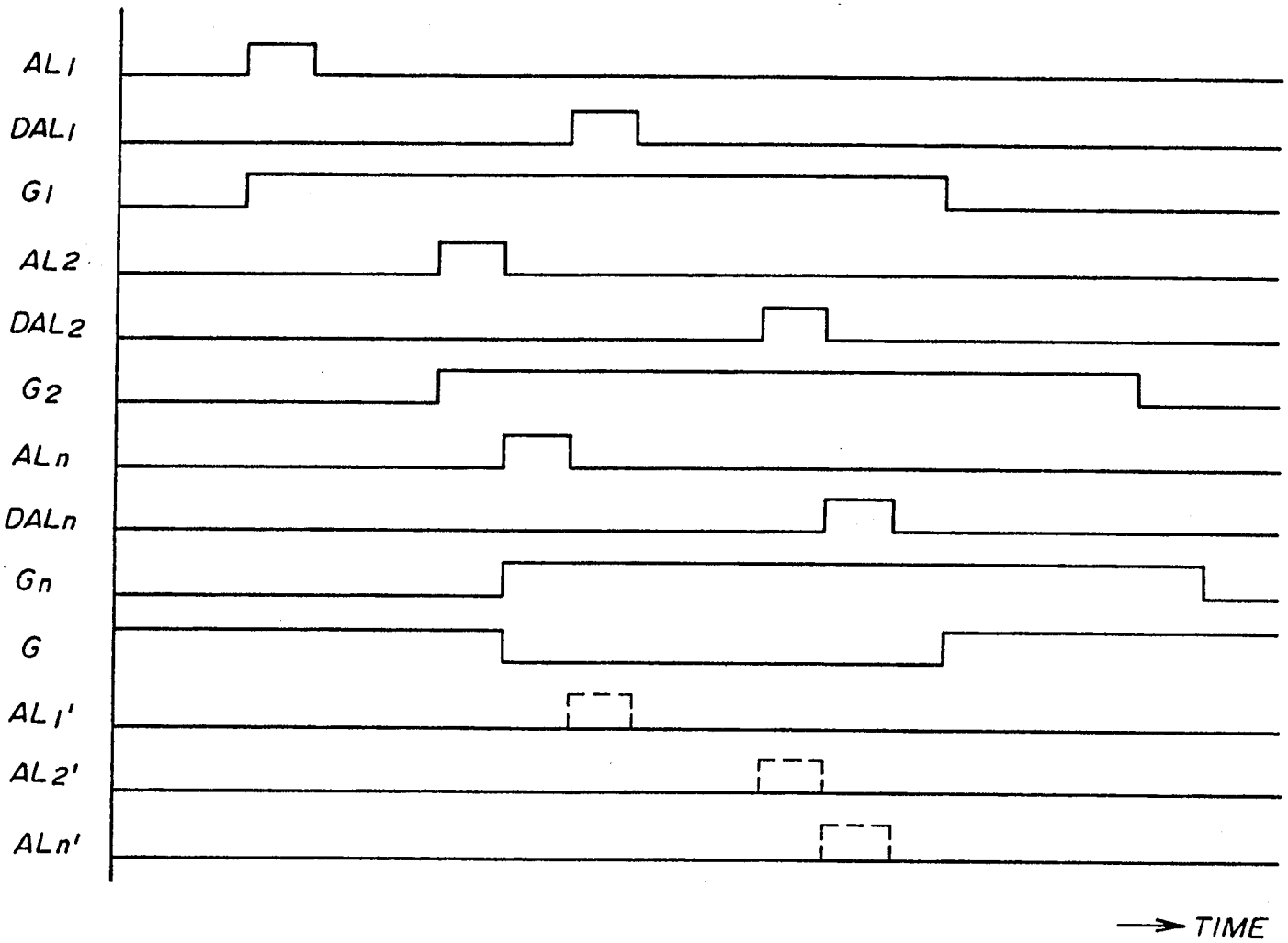
FIG. 12 is a timing chart for explaining the operation of the alarm signal processor shown in FIG. 11.

Next, a description will be given of a third embodiment of the alarm signal processor 3. FIG. 11 shows the third embodiment of the alarm signal processor 3. In FIG. 11, those parts which are the same as those corresponding parts in FIG. 6 are designated by the same reference numerals, and a description thereof will be omitted. Further, FIG. 12 is a timing chart for explaining the operation of the alarm signal processor 3 shown in FIG. 11.

In FIG. 11, each gate circuit $7j$ is made up of an AND circuit A. In addition, a NAND circuit 9 receives the gate signals G1 through Gn and supplies an output signal G to each of the gate circuits $7_l$ through $7_n$. Furthermore, as shown in FIG. 12, the alarm signals AL1 through ALn are mutually cancelled only if all of the alarm signals AL1 through ALn are generated approximately at the same time.

This alarm signal processor 3 shown in FIG. 11 is suited for use in the switch controller of the communication system in which the duplexed ratio is 1:N. In other words, if the channels CH1 through CHn-1 are the working system and the channel CHn is the protection system, for example, this third embodiment of the alarm signal processor 3 is effective when the switching of the system is to be prohibited only if the failure is generated in the high speed part (specific common part) of the upstream side part.

Of course, it is not essential to block each of the delayed alarm signals DAL1 through DALn by the logical product signal of all of the gate signals G1 through Gn. In general, each of the delayed alarm signals DAL1 through DALn may be blocked by the logical product signal of two or more arbitrary ones of the gate signals G1 through Gn.

The embodiments and modification of the alarm signal processor 3 described above are suited for use in the switch controller under various conditions, including a case where the switch controller employs the majority logic.

Figure 13:
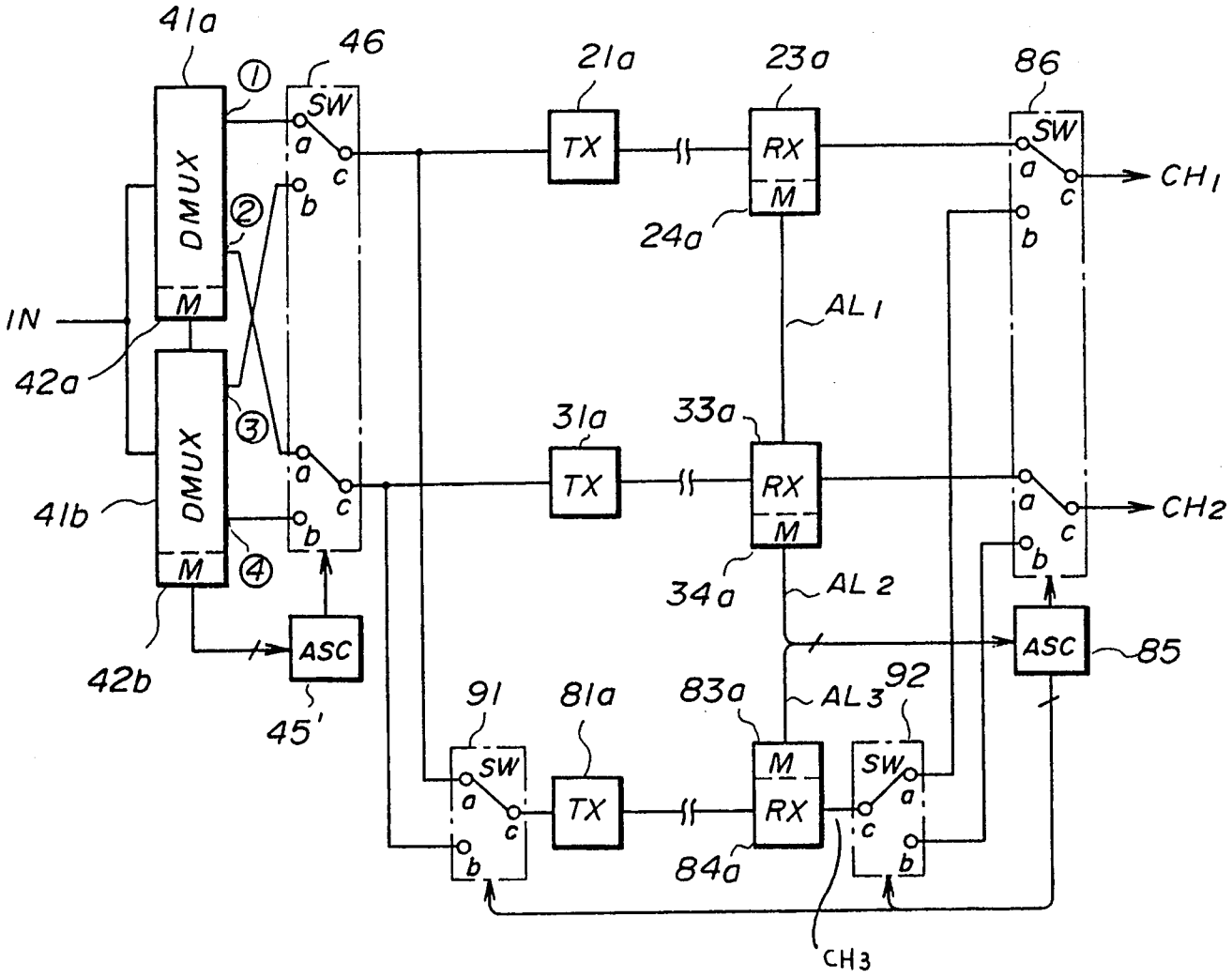
FIG. 13 is a system block diagram showing an essential part of a second embodiment of the communication system according to the present invention.

Next, a description will be given of a second embodiment of the communication system according to the present invention, by referring to FIG. 13. In FIG. 13, those parts which are the same as those corresponding parts in FIG. 5 are designated by the same reference numerals, and a description thereof will be omitted.

In this embodiment, the present invention is applied to the communication system in which the duplexed ratio is 1:2. The channels CH1 and CH2 form the working systems, and the channel CH3 forms the protection system. The channel CH3 is connected to the channel CH1 or CH2 on the transmitting side by a switch 91. Accordingly, the same transmission signal is transmitted via the channel CH3 and the channel CH1 or CH2.

A description will be given of the switch control operation of a switch controller 85. First, if none of the alarm signals AL1 through AL3 are generated or, if only one of the alarm signals AL1 through AL3 is generated, the switch control operation of the switch controller 85 is basically the same as that of the conventional case.

Next, if the alarm signals AL1 and AL3 are generated approximately at the same time, it may be regarded that the failure is generated in the system of the channel CH1 on the upstream side prior to the multiplexing or at the output port (1) of the demultiplexer 41*a*, and the alarm signals AL1 and AL3 are disregarded. In this case, the alarm signal processor 3 shown in FIG. 6 may be used in the switch controller 85. Similarly, the alarm signals AL2 and AL3 are disregarded if the alarm signals AL2 and AL3 are generated approximately at the same time. If the alarm signals AL1, AL2 and AL3 are generated approximately at the same time, it may be regarded that the failure is generated in the high-speed part IN on the upstream side or at the output port (1) or (2) of the demultiplexer 41*a*, and the alarm signals AL1, AL2 and AL3 are disregarded. In this case, the alarm signal processor 3 shown in FIG. 11 may be used in the switch controller 85.

In the embodiments of the communication system described above, the switch controller ASC is described as having one of the first through third embodiments of the alarm signal processor 3. However, the construction of the switch controller ASC is not limited to the above, and the functions of the alarm signal processor 3 and the switch controller ASC may be realized by a central processing unit (CPU) based on program control, so as to disregard the alarm signals which are generated approximately at the same time in arbitrary systems and to otherwise accept the alarm signal.

The present invention is applied to the SONET system in the embodiments described above. However, the present invention is applicable to all kinds of communication systems having working and protection systems, including wire or radio communication systems.

Further, the present invention is not limited to these embodiments, but various variations and modifications may be made without departing from the scope of the present invention.

What is claimed is:

1. A communication system comprising:

at least one working system for receiving a signal from a source;

at least one protection system for receiving the signal from said source;

detection means, coupled to said working system and said protection system, for detecting an alarm state of the signals received via the working system and the protection system and for outputting an alarm signal if the alarm state is detected in at least one of the working system and the protection system;

switching means, coupled to said working system and said protection system, for selectively outputting the signal received via one of the working system and the protection system in response to a control signal which determines a connection of said switching means; and control means, coupled to said detection means and said switching means, for supplying the control signal to said switching means based on the alarm signals from said detection means, said control means disregarding the alarm signals if the alarm signals are generated from said detection means with respect to the working system and the protection system approximately at the same time.

2. The communication system as claimed in claim 1, wherein a duplexed ratio of the number of protection systems to the number of working systems is 1:N, where N is an arbitrary integer.

3. The communication system as claimed in claim 1, wherein said protection system is provided with respect to each working system.

4. The communication system as claimed in claim 1, wherein said control means includes an alarm signal processor for mutually cancelling the alarm signals which are generated from said detection means with respect to a plurality of systems approximately at the same time and for otherwise passing the alarm signals.

5. The communication system as claimed in claim 4, wherein said alarm signal processor comprises:

delay means for delaying each of n alarm signals by a leading guard time, where n is an integer greater than or equal to two;

gate signal forming means for forming n gate signals respectively having a time width amounting to a sum of the leading guard time, a trailing guard time and a duration of a corresponding one of the n gate signals based on the n alarm signals; and gate means for blocking each of n delayed alarm signals output from said delay means by a logical sum of two or more gate signals other than the gate signal corresponding thereto.

6. The communication system as claimed in claim 5, wherein said alarm signal processor further comprises erroneous operation preventing means, coupled to an input side of said gate signal forming means, for preventing the control signal from switching the connection of said switching means even when the alarm signal is generated from said detection means if a time width of the alarm signal is shorter than the period of a clock signal used in said delay means and said gate signal forming means.

7. The communication system as claimed in claim 5, wherein said alarm signal processor further comprises protection means, coupled to an output side of said gate means, for preventing the control signal from switching the connection of said switching means unless the alarm signal generated from said detection means exists over a predetermined time.

8. The communication system as claimed in claim 5, wherein said sum determines a time range which is considered as being approximately the same time.

9. The communication system as claimed in claim 4, wherein said alarm signal processor comprises:

delay means for delaying each of n alarm signals by a leading guard time, where n is an integer greater than or equal to two;

gate signal forming means for forming n gate signals respectively having a time width amounting to a sum of the leading guard time, a trailing guard time and a duration of a corresponding one of the n alarm signals based on the n alarm signals; and gate means for blocking each of n delayed alarm signals output from said delay means by a logical product of two or more arbitrary gate signals.

10. The communication system as claimed in claim 1, wherein said working system, said protection system, said detection means, said switching means and said control means are provided in a receiving end for receiving a transmission signal transmitted from a transmitting end.

11. The communication system as claimed in claim 1, wherein said working system, said protection system, said detection means, said switching means and said control means are provided in a transmitting end for transmitting a transmission signal to a receiving end.

12. The communication system as claimed in claim 1, wherein a pulse width of each alarm signal is greater than said leading guard time.

* * * * *